US007150950B2

(12) United States Patent
Yu et al.

(10) Patent No.: US 7,150,950 B2
(45) Date of Patent: Dec. 19, 2006

(54) PHOTOSENSITIVE MEMBER HAVING GROUND STRIP WITH LIGNIN SULFONIC ACID DOPED POLYANILINE

(75) Inventors: Robert C. U. Yu, Webster, NY (US); Satchidanand Mishra, Webster, NY (US); Anthony M. Horgan, Pittsford, NY (US); Richard L. Post, Penfield, NY (US); Edward F. Grabowski, Webster, NY (US); Kathleen M. Carmichael, Willimson, NY (US); Satish Parikh, Rochester, NY (US); Bing R. Hsieh, Webster, NY (US); Donald C. VonHoene, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 359 days.

(21) Appl. No.: 10/824,794

(22) Filed: Apr. 14, 2004

(65) Prior Publication Data

US 2005/0233229 A1 Oct. 20, 2005

(51) Int. Cl.
*G03G 5/00* (2006.01)

(52) U.S. Cl. ..... 430/66; 430/67; 430/56; 399/159

(58) Field of Classification Search ..... 430/66, 430/67, 58.2, 56; 399/159
See application file for complete search history.

(56) References Cited

U.S. PATENT DOCUMENTS 4,664,995 A 5/1987 Horgan et al. ..... 430/59
5,382,486 A 1/1995 Yu et al. ..... 430/56
5,686,214 A 11/1997 Yu ..... 430/58
5,968,417 A 10/1999 Viswanathan ..... 252/500
6,071,662 A 6/2000 Carmichael et al. ..... 430/69
6,132,923 A 10/2000 Maty et al. ..... 430/129
6,303,254 B1 10/2001 Yu et al. ..... 430/56
6,932,921 B1 * 8/2005 Service ..... 252/500

OTHER PUBLICATIONS

Diamond, Arthur S & David Weiss (eds.) Handbook of Imaging Materials. New York: Marcel-Dekker, Inc. (Nov. 2001) pp. 149-164.*

* cited by examiner

*Primary Examiner*—Christopher Rodee
(74) *Attorney, Agent, or Firm*—Annette L. Bade

(57) ABSTRACT

An electrostatographic imaging member having a flexible supporting substrate, an imaging layer capable of retaining an electrostatic latent image, and an electrically conductive ground strip layer comprising a film forming binder and a lignin sulfonic acid doped polyaniline dispersion, and an image forming apparatus with the above imaging member to receive an electrostatic latent image on a charge-retentive surface of the imaging member; a development component to apply toner to the charge-retentive surface to develop the electrostatic latent image to form a developed toner image on the charge-retentive surface; a transfer component to transfer the developed toner image from the charge-retentive surface to a receiving copy substrate; and a fixing component to fuse the developed image to the receiving copy substrate.

15 Claims, 2 Drawing Sheets

PHOTOSENSITIVE MEMBER HAVING GROUND STRIP WITH LIGNIN SULFONIC ACID DOPED POLYANILINE

CROSS-REFERENCE TO RELATED APPLICATIONS

Reference is made to commonly-assigned, copending U.S. patent application Ser. No. 10/825,450, filed 14 Apr. 2004, (D/A2533) entitled, "Photosensitive Member Having Anti-Curl Backing Layer with Lignin Sulfonic Acid Doped Polyaniline;" and U.S. patent application Ser. No. 10/825,453, filed 14 Apr. 2004, (D/A1391) entitled, "Imageable Seamed Belts with Lignin Sulfonic Acid Doped Polyaniline." The disclosure of this commonly assigned application being hereby incorporated by reference in its entirety.

BACKGROUND

Herein is described flexible electrostatographic imaging members including electrophotographic imaging members (such as photosensitive members, photoreceptors, photoconductors, and the like) and ionographic imaging members, useful in electrostatographic apparatuses, including printers, copiers, other reproductive devices, image on image, and digital apparatuses, and the like. Flexible electrostatographic imaging members can be seamed or seamless belts. They can also be a sheet, a scroll, or being a belt mounted over a rigid drum structure to form a drelt. In embodiments, the photosensitive members have an electrically conductive ground strip layer situated at one edge of the photosensitive member, comprising a conductive filler dispersed in a binder. In embodiments, the binder is a film forming polymer and the conductive filler is lignin sulfonic acid doped polyaniline. In embodiments, the ground strip layer has absolute opacity. In embodiments, the use of lignin sulfonic acid doped polyaniline filler and a film forming polymer binder in the ground strip layer provides a simpler material formulation, and allows the ease of ground strip layer preparation procedures to effect electrical grounding continuity during photosensitive member imaging machine function.

Since the seam of a flexible seamed electrostatographic imaging member belt represents physical and photo-electrical discontinuity of the belt, the seam is seen to manifest itself into a printout defect to impact copy quality. To resolve this problem, the ground strip layer is therefore required to be opaque such that a timing hole can be punched out at a specific location to affect accurate registration of the belt and thereby avoid images formation directly over the seam.

For reasons of simplicity, the descriptions of electrostatographic imaging members will herein after be represented and focused only on electrophotographic imaging members in flexible seamed photoreceptor belt configuration.

Flexible electrophotographic imaging members, including photoreceptors, photosensitive members, or photoconductors, typically include a photoconductive layer formed on an electrically conductive flexible substrate or formed on layers between the substrate and other photoconductive layers. The photoconductive layer is an insulator in the dark, so that electric charges are retained on its surface. Upon exposure to light, the charge is dissipated, and an image can be formed thereon, developed using a developer material, transferred the developed image to a copy substrate, and fused thereto to form a copy or print.

The photoconductive layer may include a single layer or several layers. In embodiments wherein there are two layers, these two layers may include two electrically operative layers positioned on an electrically conductive layer with a photoconductive layer sandwiched between a contiguous charge transport layer and the conductive layer. The outer surface of the charge transport layer is normally charged in the dark with a uniform negative electrostatic charge, and the conductive layer is used as an electrode.

In order to properly form an image on an electrophotographic imaging member surface, the conductive layer must be brought into electrical contact with a source of fixed potential elsewhere in the imaging device. This electrical contact must be effective over many thousands of imaging cycles in automatic imaging devices. Since the conductive layer is often a thin vapor deposited metal over the surface of a flexible substrate, long life cannot be achieved with an ordinary electrical contact that rubs directly against the thin conductive layer causing total wear through the layer. One approach to minimize the wear of the thin conductive layer is to use a grounding brush such as that described in U.S. Pat. No. 4,402,593. However, such an arrangement is generally not adequate to provide extended service runs in copiers, duplicators, and printers.

Still another approach to extend the functional life as well as improving electrical contact between the thin conductive layer of flexible electrophotographic imaging members and a grounding means is the use of a relatively thick, but narrow width, electrically conductive grounding strip layer coated over and in contact with the conductive layer, and adjacent to one edge of the photoconductive or dielectric imaging layer. Generally the grounding strip layer comprises opaque conductive particles dispersed in a film forming polymer binder. This approach to grounding the thin conductive layer increases the overall life of the imaging layer because it is more durable than the thin conductive layer. However, such relatively thick ground strip layers are still subject to erosion and contribute to the formation of undesirable "dirt" in high volume imaging devices. Erosion is particularly severe in electrophotographic imaging systems using metallic grounding brushes, or sliding metal contacts, or grounding blocks. Moreover, mechanical wear through failure in the grounding strip layer is accelerated under exposure to high humidity conditions. Furthermore, the typical grounding strip layer does often comprise complex material compositions and tedious preparation procedures not convenient to formulate.

In systems using a timing light in combination with a timing aperture (a timing hole punched through) in the ground strip layer for controlling various functions of imaging devices and give precision registration, the erosion of the ground strip layer by devices such as stainless steel grounding brushes or sliding metal block contacts is frequently very severe. The result is that the ground strip layer has local totally worn through spots and become transparent. This, in turn, allows light to pass through the worn spots in the ground strip layer and create false timing signals, thereby giving belt registration errors. The final outcome is that the imaging device prematurely shuts down the useful functional life of the belt. Moreover, the opaque conductive particles/debris generated due to abrasion and erosion of the grounding strip layer, tend to drift and settle on other components of the machine such as the lens system, corotron, other electrical components, and the like. This, in turn, adversely affects machine performance. For example, at a relative humidity of 85 percent, the ground strip layer life can be as low as 100,000 to 150,000 cycles in high quality electrophotographic imaging members. Also, due to the rapid erosion of the ground strip layer, the electrical conductivity of the ground strip layer may decline to unacceptable levels during extended cycling.

Incorporation of micro-crystalline silica particles into ground strip layers has produced excellent improvement in wear resistance. Photoreceptors containing this type of ground strip are described in U.S. Pat. No. 4,664,995. However, due to their extreme hardness, concentrations of silica over about 5 percent in ground strip layers have caused ultrasonic welding horns to rapidly wear as the horn is passed over the ground strip layer during photoreceptor seam welding processes. High welding horn wear is undesirable because horn service life is shortened, horn replacement is very costly, and production line down time is increased.

U.S. Pat. No. 4,664,995 discloses a ground strip comprising a film forming binder, conductive particles and microcrystalline silica particles dispersed in the film forming binder, and a reaction product of a bi-functional chemical coupling agent which interacts with both the film forming binder and the microcrystalline silica particles.

U.S. Pat. No. 5,382,486 discloses a ground strip layer comprising an electrically conductive polymer.

U.S. Pat. No. 5,686,214 discloses a ground strip layer having organic fillers therein.

U.S. Pat. No. 4,664,995 discloses a ground strip having inorganic fillers therein.

There still remains a problem of an inconsistency in opacity and very poor quality of conductive graphite particles dispersion in the material matrix of the prior art grounding strip. This affects proper photoreceptor belt registration during machine function. The optical problem of the ground strip formulation has been caused by poor graphite particle dispersion in the material matrix of the ground strip layer. In embodiments, use of lignin sulfonic acid doped polyaniline (Ligno-PANi) dispersed or contained in the polymer binder of grounding strip layer, provides excellent electrical conductivity and meets the ground strip layer opacity requirement. Furthermore, the wear resistance of the formulated ground strip layer is also effectively enhanced by incorporation of an organic or inorganic filler dispersion.

SUMMARY

Embodiments include an electrostatographic imaging comprising a flexible supporting substrate, an imaging layer capable of retaining an electrostatic latent image, and an electrically conductive ground strip layer comprising a film forming binder and a first filler comprising a lignin sulfonic acid doped polyaniline dispersion.

Embodiments further include an image forming apparatus for forming images on a recording medium comprising a photoreceptor comprising a charge-retentive surface to receive an electrostatic latent image thereon, the photoreceptor comprising a flexible supporting substrate, an imaging layer capable of retaining the electrostatic latent image, and an electrically conductive ground strip layer comprising a film forming binder and a lignin sulfonic acid doped polyaniline dispersion; a development component to apply toner to the charge-retentive surface to develop the electrostatic latent image to form a developed toner image on the charge retentive surface; a transfer component to transfer the developed toner mage from the charge retentive surface to a receiving copy substrate; and a fixing component to fuse the developed toner image to the receiving copy substrate.

Embodiments also include an image forming apparatus for forming images on a recording medium comprising a photoreceptor comprising a charge-retentive surface to receive an electrostatic latent image thereon, the photoreceptor comprising a flexible supporting substrate, an imaging layer capable of retaining the electrostatic latent image, and an electrically conductive ground strip layer adjacent to the imaging layer, wherein the electrically conductive ground strip layer comprises a film forming polymer binder, a lignin sulfonic acid doped polyaniline dispersion, and a polytetrafluoroethylene filler; a development component to apply toner to the charge-retentive surface to develop the electrostatic latent image to form a developed toner image on the charge retentive surface; a transfer component to transfer the developed toner image from the charge retentive surface to a receiving copy substrate; and a fixing component to fuse the developed toner image to the receiving copy substrate.

BRIEF DESCRIPTION OF THE DRAWINGS

For a better understanding, reference may be had to the accompanying figures.

DETAILED DESCRIPTION

Figure 1:
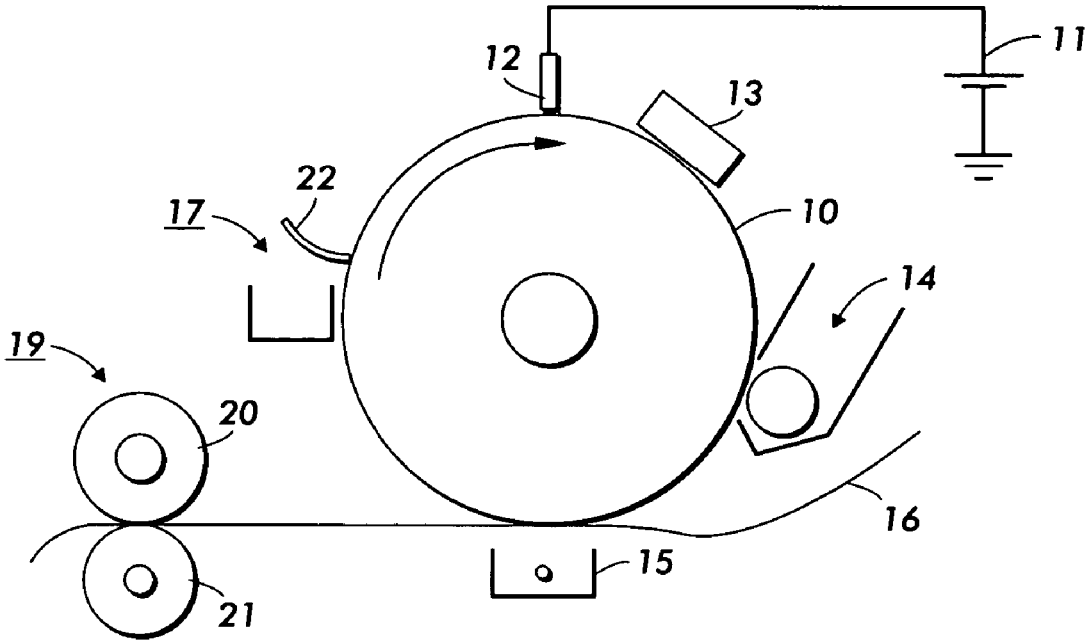
FIG. 1 is an illustration of a general electrophotographic imaging apparatus using a photoreceptor member.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10, show in FIG. 1 as a drelt consisting of a flexible photoreceptor belt mounted and encircled a rigid drum, is charged on its surface by means of an electrical charger 12 to which a voltage has been supplied from power supply 11. The photoreceptor 10 is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process.

After the toner particles have been deposited on the photoconductive surface, in image configuration, they are transferred to a receiving copy sheet 16 by transfer means 15, which can be pressure transfer or electrostatic transfer. In embodiments, the developed toner image can be transferred to an intermediate transfer member and subsequently transferred to a receiving copy sheet, or directly transferred to a copy sheet.

After the transfer of the developed toner image is completed, copy sheet 16 advances to fusing station 19, depicted in FIG. 1 as fusing and pressure rolls, wherein the developed toner mage is fused to copy sheet 16 by passing copy sheet 16 between the fusing member 20 and pressure member 21, thereby forming a permanent image. Fusing may be accomplished by other fusing members such as a fusing belt in pressure contact with a pressure roller, fusing roller in contact with a pressure belt, or other like systems. Photoreceptor 10, subsequent to transfer, advances to cleaning station 17, wherein any residual toner left on photoreceptor 10 is cleaned therefrom by use of a blade 22 (as shown in FIG. 1), brush, or other cleaning apparatus.

Figure 2:
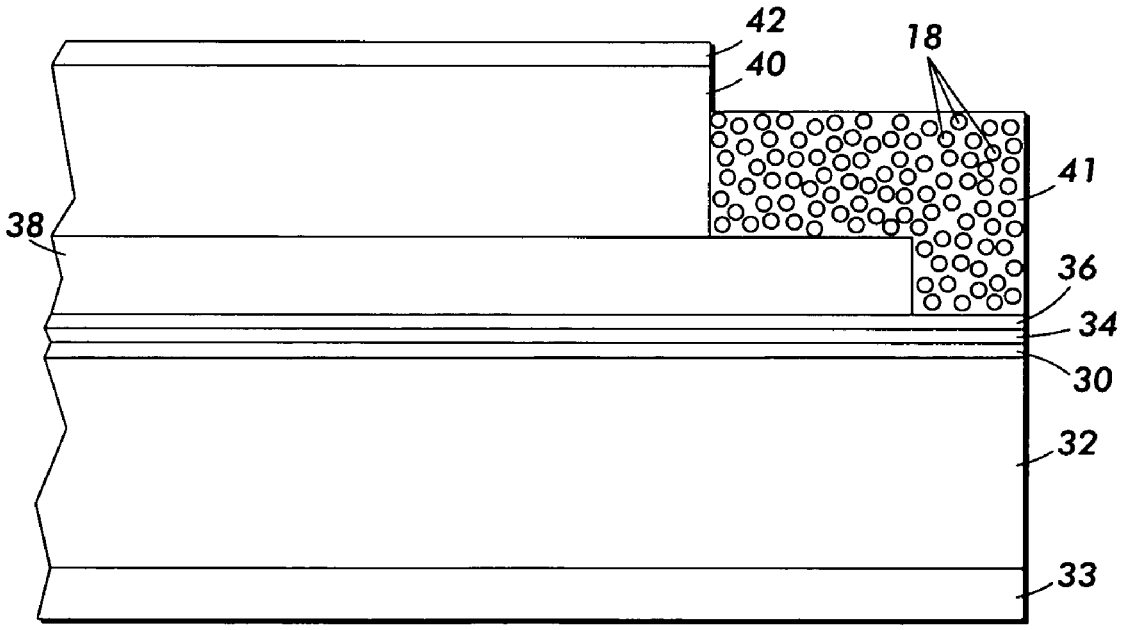
FIG. 2 is an illustration of an embodiment of a photoreceptor belt cross-sectional view showing various layers.

A typical charged, multilayered electrophotographic imaging member of flexible web stock, belt, film or drelt configuration is illustrated in FIG. 2. Generally, such a member includes a flexible substrate support layer 32 on which a conductive layer 30, a hole blocking layer 34, a photogenerating layer 38, and an active charge transport layer 40 are formed. An optional adhesive layer 36 can be applied to the hole blocking layer 34 before the photogenerating layer 38 is deposited to provide adhesion linkage. Optionally, an overcoat layer 42 can be applied to provide protection against chemical attack and improve resistance to abrasion. Other layers, such as a grounding strip layer 41 coated at one edge of the imaging member can be used to facilitate contact and provide electrical continuity with the conductive layer 30 for effectual grounding. On the opposite surface of substrate support 32, an anticurl back coating 33 can be applied to balance the curling induced by the different coefficients of thermal contraction and expansion of the various layers of the belt and render flatness.

Examples of electrophotographic imaging members having at least two electrically operative layers, including a charge generator layer and diamine containing transport layer, are disclosed in U.S. Pat. Nos. 4,265,990, 4,233,384, 4,306,008, 4,299,897, and 4,439,507, and U.S. Patent Publication No. 20030067097, the disclosures thereof being incorporated herein in their entirety.

The thickness of the substrate support 32 can depend on factors including mechanical strength, flexibility, and economical considerations, and can reach, for example, a thickness of at least about 50 μm. A typical maximum thickness of about 150 μm can also be achieved, provided there are no adverse effects on the final electrophotographic imaging device. The substrate support 32 should not soluble in any of the solvents used in each coating layer solution, optically clear, and being thermally stable enable to stand up to a high temperature of about 150° C.

The conductive layer 30 can vary in thickness over substantially wide ranges depending on the optical transparency and flexibility desired for the electrophotographic imaging member. Accordingly, when a flexible electrophotographic imaging belt is desired, the thickness of the conductive layer can be between about 20 Å and about 750 Å, or between about 50 Å and about 200 Å for an optimum combination of electrical conductivity, flexibility and light transmission. The conductive layer 30 can be an electrically conductive metal layer formed, for example, on the substrate by any suitable coating technique. Alternatively, the entire substrate can be an electrically conductive metal, the outer surface thereof performing the function of an electrically conductive layer and a separate electrical conductive layer may be omitted.

After formation of an electrically conductive surface, the hole-blocking layer 34 can be applied thereto. The blocking layer 34 can comprise nitrogen containing siloxanes or nitrogen containing titanium compounds as disclosed, for example, in U.S. Pat. Nos. 4,291,110, 4,338,387, 4,286,033, and 4,291,110, the disclosures of these patents being incorporated herein in their entirety.

An optional adhesive layer 36 can be applied to the hole blocking layer. Any suitable adhesive layer may be used, such as a linear saturated copolyester reaction product of four diacids and ethylene glycol. Any adhesive layer employed should be continuous or have a dry thickness between about 200 μm and about 900 μm, or between about 400 μm and about 700 μm. Any suitable solvent or solvent mixtures can be employed to form a coating solution of polyester. Any other suitable and conventional technique may be used to mix and thereafter apply the adhesive layer coating mixture of this invention to the charge-blocking layer.

Any suitable photogenerating layer 38 can be applied to the blocking layer 34 or adhesive layer 36, if such an adhesive layer 36 is employed, which can thereafter be overcoated with a contiguous hole transport layer 40. Appropriate photogenerating layer materials are known in the art, such as benzimidazole perylene compositions described, for example in U.S. Pat. No. 4,587,189, the entire disclosure thereof being incorporated herein by reference. More than one composition can be employed where a photoconductive layer enhances or reduces the properties of the photogenerating layer. Other suitable photogenerating materials known in the art can also be used, if desired. Any suitable charge generating binder layer comprising photoconductive particles dispersed in a film forming binder can be used. Additionally, any suitable inactive resin materials can be employed in the photogenerating binder layer including those described, for example, in U.S. Pat. No. 3,121,006, the entire disclosure thereof being incorporated herein by reference.

The photogenerating layer 38 containing photoconductive compositions and/or pigments and the resinous binder material generally ranges in thickness of from about 0.1 μm to about 5 μm, or from about 0.3 micrometer to about 3 μm. The photogenerating layer thickness is related to binder content. Higher binder content compositions generally require thicker layers for photogeneration.

The active charge transport layer 40 can comprise any suitable activating compound useful as an additive dispersed in electrically inactive polymeric materials making these materials electrically active. These compounds may be added to polymeric materials that are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. Thus, the active charge transport layer 40 can comprise any suitable transparent organic polymer or non-polymeric material capable of supporting the injection of photogenerated holes and electrons from the trigonal selenium binder layer and allowing the transport of these holes or electrons through the organic layer to selectively discharge the surface charge. The active charge transport layer 40 not only serves to transport holes or electrons, but also protects the photoconductive layer 38 from abrasion or chemical attack and therefore extends the operating life of the photoreceptor imaging member. The charge transport layer 40 should exhibit negligible, if any, discharge when exposed to a wavelength of light useful in xerography, for example, 4000 Å to 9000 Å. Therefore, the charge transport layer is substantially transparent to radiation in a region in which the photoconductor is to be used. Thus, the active charge transport layer is a substantially non-photoconductive material that supports the injection of photogenerated holes from the generation layer. The active transport layer is normally transparent when exposure is effected through the active layer to ensure that most of the incident radiation is utilized by the underlying charge carrier generator layer for efficient photogeneration. The charge transport layer in conjunction with the generation layer in the instant invention is a material that is an insulator to the extent that an electrostatic charge placed on the transport layer is not conducted in the absence of illumination.

The charge transport layer forming mixture may comprise an aromatic amine compound. An example of a charge transport layer employed in one of the two electrically operative layers in the multi-layer photoreceptor comprises from about 35 percent to about 45 percent by weight of at least one charge transporting aromatic amine compound, and about 65 percent to about 55 percent by weight of a polymeric film forming resin in which the aromatic amine is soluble. The substituents may be free form electron withdrawing groups such as $NO_2$ groups, CN groups, and the like, and are typically dispersed in an inactive resin binder.

The charge transport layer 40 should be an insulator to the extent that the electrostatic charge placed on the charge transport layer is not conducted in the absence of illumination at a rate sufficient to prevent formation and retention of an electrostatic latent image thereon. In general, the ratio of the thickness of the hole transport layer to the charge generator layer may be maintained from about 2.1 to 200:1 and in some instances as great as 400:1. Generally, the thickness of the transport layer 40 is between about 5 μm and about 100 μm, but thickness outside this range can also be used provided that there are no adverse effects.

Other layer, such as conventional ground strip layer 41 comprising, for example, conductive particles, such as Ligno-PANi fillers 18 dispersed in a film forming polymer binder, may be applied to one edge of the photoreceptor in contact with the conductive layer 30, hole blocking layer, adhesive layer 36, charge transport layer 40, or charge generating layer 38. The ground strip layer, in embodiments, is electrically conductive. The function of the ground strip layer is not only to provide electrical contact and linkage between the machine ground device and the photoreceptor conductive ground plane during imaging process. The ground strip layer, in embodiments, has total opacity so that the timing hole created in the ground strip layer affects precision photoreceptor belt registration and prevents occurrence of seam area image copy printout problems.

In embodiments, the ground strip layer may be coated adjacent to the charge transport layer and situated at one edge of the photoreceptor belt. The ground strip layer 41 may be coated over the adhesive layer 36 and also positioned in contact with the charge generating 38 as well as the charge transport layer 40 to establish connection of the electrically conductive ground plane 30 of the imaging member to ground or to an electrical bias through typical contact means such as a conductive brush, conductive leaf spring, and the like. There may be included an electrically conductive ground plane layer positioned between the substrate and imaging layer. The ground strip 41 may be adjacent to the imaging layer and in electrical contact with the electrically conductive ground plane layer. The ground strip 41 can comprise any suitable film forming polymer binder such as polycarbonate and electrically conductive particles dispersion, such as lignin sulfonic acid doped polyaniline (Ligno-PANi) fillers 18 to meet optical opacity requirement, give good bulk electrical conductivity, and have strong adhesion bond strength to all the contacting layers. The ground strip layer 41 may have a thickness from about 7 to about 42 micrometers, or from about 14 to about 23 micrometers. Optionally, an overcoat layer 42, if desired, can also be applied directly over the charge transport layer 40 for use to improve resistance and provide protection to imaging member surface against abrasion.

The charge transport layer 40 typically has a great thermal contraction mismatch compared to that of the substrate support 32. As a result, the prepared flexible electrophotographic imaging member exhibits spontaneous upward curling due to the result of larger dimensional contraction in the charge transport layer than the substrate support, especially as the imaging member cools down to room ambient after the heating/drying processes of the applied wet charge transport layer coating. An anti-curl back coating 33 can be applied to the back side of the substrate support 32 (which is the side opposite the side bearing the electrically active coating layers) to induce flatness. The anticurl back coating 33 can comprise any suitable organic or inorganic film forming polymers that are electrically insulating or slightly semi-conductive.

In embodiments, the thermoplastic film forming polymer for the anti-curl back coating application satisfies all the physical, mechanical, optical, and thermal requirements above. The selected film forming thermoplastic polymer for anticurl back coating 33 application, if desired, can be of the same binder polymer used in the charge transport layer 40.

The fabricated multilayered, flexible electrophotographic imaging member web stock of FIG. 2 can then be cut into rectangular or parallelogram shape sheets to give photoreceptor web, film, scroll, flexible substrate, or any suitable form. However, the cut sheets are generally converted into flexible seamed imaging member belts, such as by ultrasonic seam welding or solvent welding technique. In the case of a seamed belt, the belt seam, if desired, may alternatively include interlocking seaming members, such as puzzle cut seam. Examples of interlocking seams, such as puzzle-cut adhesive bonded seams, and processes for making such seams can be found in commonly assigned U.S. Pat. No. 6,379,486, the disclosure of which is hereby incorporated by reference in its entirety. In addition, a seamed photoreceptor belt may be mounted over and encircled a rigid drum to form a drelt same as that of photoreceptor 10 shown in FIG. 1.

Figure 3:
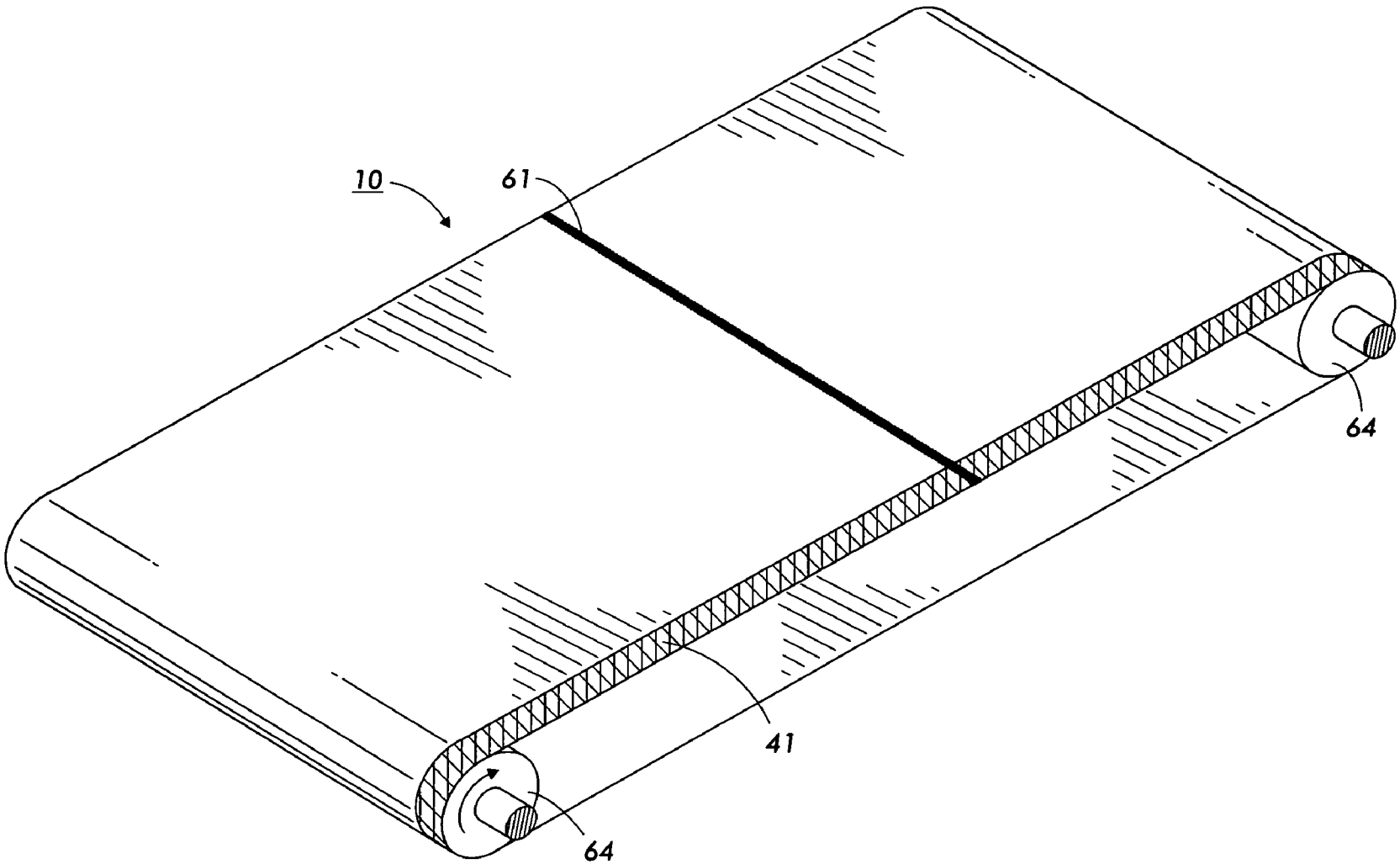
FIG. 3 is an enhanced view of an embodiment of a welded seamed belt configuration.

FIG. 3 demonstrates an example of an embodiment of a belt. Belt 10 is demonstrated with seam 61. Seam 61 is pictured as an example of one embodiment of an ultrasonically welded belt. The belt is held in position and turned by use of rollers 64 (one being a drive roller while the other is a free rotation idled roller). Note that the ultrasonically welded seam 61 and the ground strip layer 41 are present in a two-dimensional plane when the belt 10 is on a flat surface, whether it be horizontal or vertical. While the seam 64 is illustrated in FIG. 3 as being perpendicular to the two parallel sides of the belt 10, it should be understood that it may be angled or slanted with respect to the parallel sides. This enables any noise generated in the system to be distributed more uniformly and the forces placed on each mating element or node to be reduced.

The ground strip layer 41 includes a binder and Lingo-PANi dispersion therein. The binder can be a suitable film forming having sufficient mechanical robustness and integrity to be used in a machine, requiring numerous revolutions, and in the case of a belt, numerous revolutions around various belt module support rollers. Examples of suitable film forming polymers include polycarbonate, polyester, polyarylate, polyacrylate, polyether (such as polyether ether ketone), polysulfone (such as polyethersulfone), polystyrene (such as polystyrene acrylonitrile) polyurethane, polyalkylenes (such as polyethylene, polyethylene terephthalate glycol, and the like), polyamide, polyvinyls (such as polyvinyl butyral, polyvinyl chloride, and the like), polyimides (such as polyamide imide), and the like, and mixtures thereof. The weight average molecular weights of these polymers can vary from about 20,000 to about 150,000. However, molecular weights outside this range may be used.

In embodiments, polycarbonate is the film forming polymer for the ground strip layer formulation. Polycarbonates may be a bisphenol A polycarbonate material such as poly(4,4'-isopropylidene-diphenylene carbonate) having a molecular weight of from about 35,000 to about 40,000, available as LEXAN 145 from General Electric Company and poly(4,4'-isopropylidene-diphenylene carbonate) having a molecular weight of from about 40,000 to about 45,000, available as LEXAN 141 also from the General Electric Company. A bisphenol A polycarbonate resin having a molecular weight of from about 50,000 to about 120,000 is available as MAKROLON from Farbenfabricken Bayer A.G. A lower molecular weight bisphenol A polycarbonate resin having a molecular weight of from about 20,000 to about 50,000 is available as MERLON from Mobay Chemical Company. Other types of polycarbonate of interest are poly(4,4-diphenyl-1,1'-cyclohexane carbonate) and poly(4,4'-isopropylidene-3,3'-dimethyl-diphenyl carbonate), both being film forming thermoplastic polymers, are structurally modified from bisphenol A polycarbonate. These are commercially available from Mitsubishi Chemicals.

The details of Ligno-PANi are described in literature, including U.S. Pat. No. 5,968,417, the disclosure thereof being herein incorporated by reference in its entirety. In simple language, Ligno-PANi is conductive particles each comprising polyaniline chains grafted to sulfonated lignin. Ligno-PANi is a lignin sulfonic acid doped polyaniline which may be prepared in a laboratory by passing an aqueous solution of lignosulfonic acid, ethoxylated, sodium salt through a protonated Dowex-HCR-W2 cation ion exchange column to give lignin sulfonic acid, which is further reacted with aniline to produce anilinium lignosulfonate salt, and then finally oxidatively polymerized in the presence of ammonium persulfate to form a green colored powder of electrically conducting lignosulfonic acid doped polyaniline called Ligno-PANi.

Ligno-PANi is a lignin sulfonic acid doped polyaniline. Lignin is a principal constituent of wood structure of higher plants. Lignin comprises structures from the polymerization of both coniferyl alcohol and sinapyl alcohol. Lignin may also comprise functional groups such as hydroxy, methyoxy, and carboxy groups. Lignosulfonates are sulfonated lignins or polyaryl-sulfoniac acids that are highly soluble in water. Lignosulfonates can be used as dispersants, binders, emulsion stabilizers, complexing agents, and other applications. The aryl rings of lignosulfonate polymers may comprise a variety of functional groups such as hydroxy, methoxy and carboxy groups that can be crosslinked after polymerization. Also, lignosulfonates comprise multiple sulfonic acid groups that can be used for doping polymers. Ligno-PANi is a redox active, highly dispersible, cross-linkable filler, and can be incorporated into a wide range of binders. Ligno-PANi is available commercially from NASA. Sulfonated polyaryl compounds can be attached to linearly conjugated π-systems by ionic or covalent bonds, as well as through electrostatic interactions such as hydrogen bonds. The molecular weight of Ligno-PANi may be from about 5,000 to about 200,000 or from about 10,000 to about 100,000, or from about 15,000 to about 50,000. Dispersed in a variety of polymers, Ligno-PANi can be either web-coated or extruded.

In embodiments, Ligno-PANi has the following general Formula I:

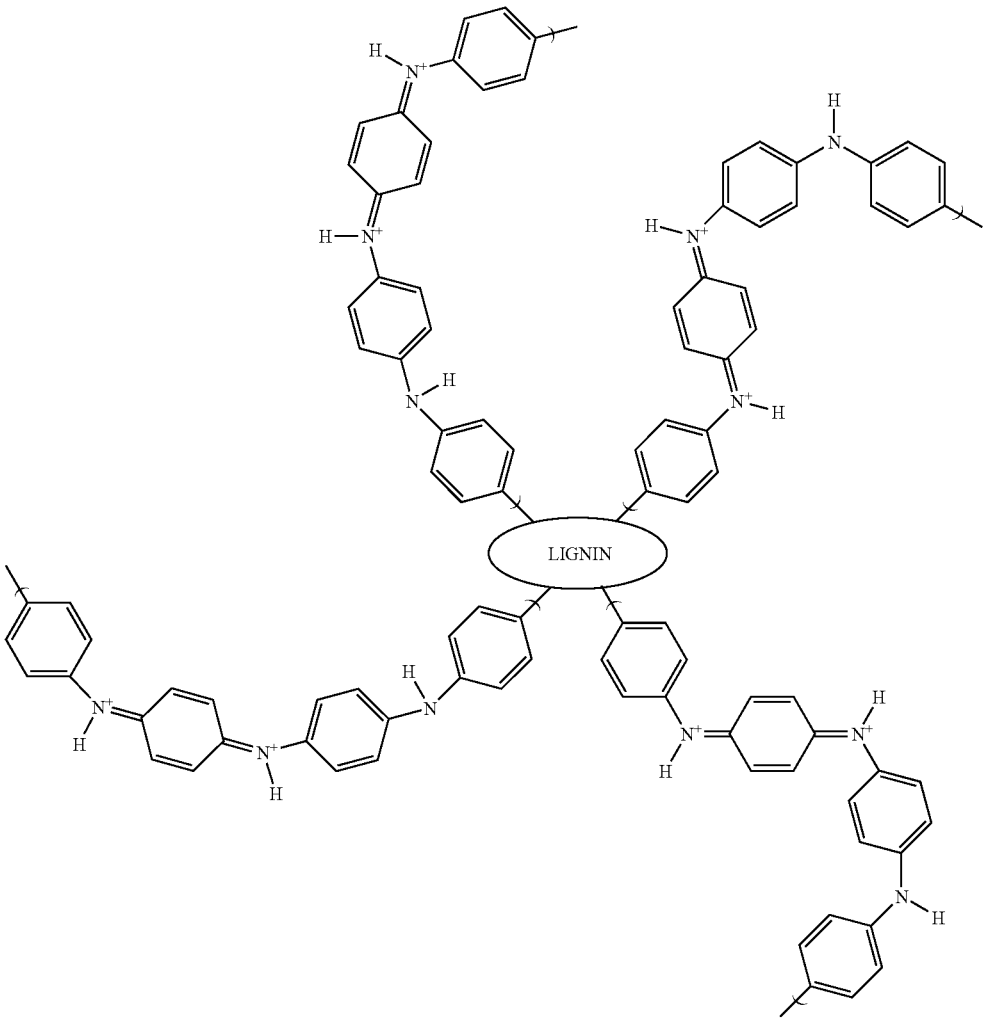

In other embodiments, the Ligno PANi has the following Formula II:

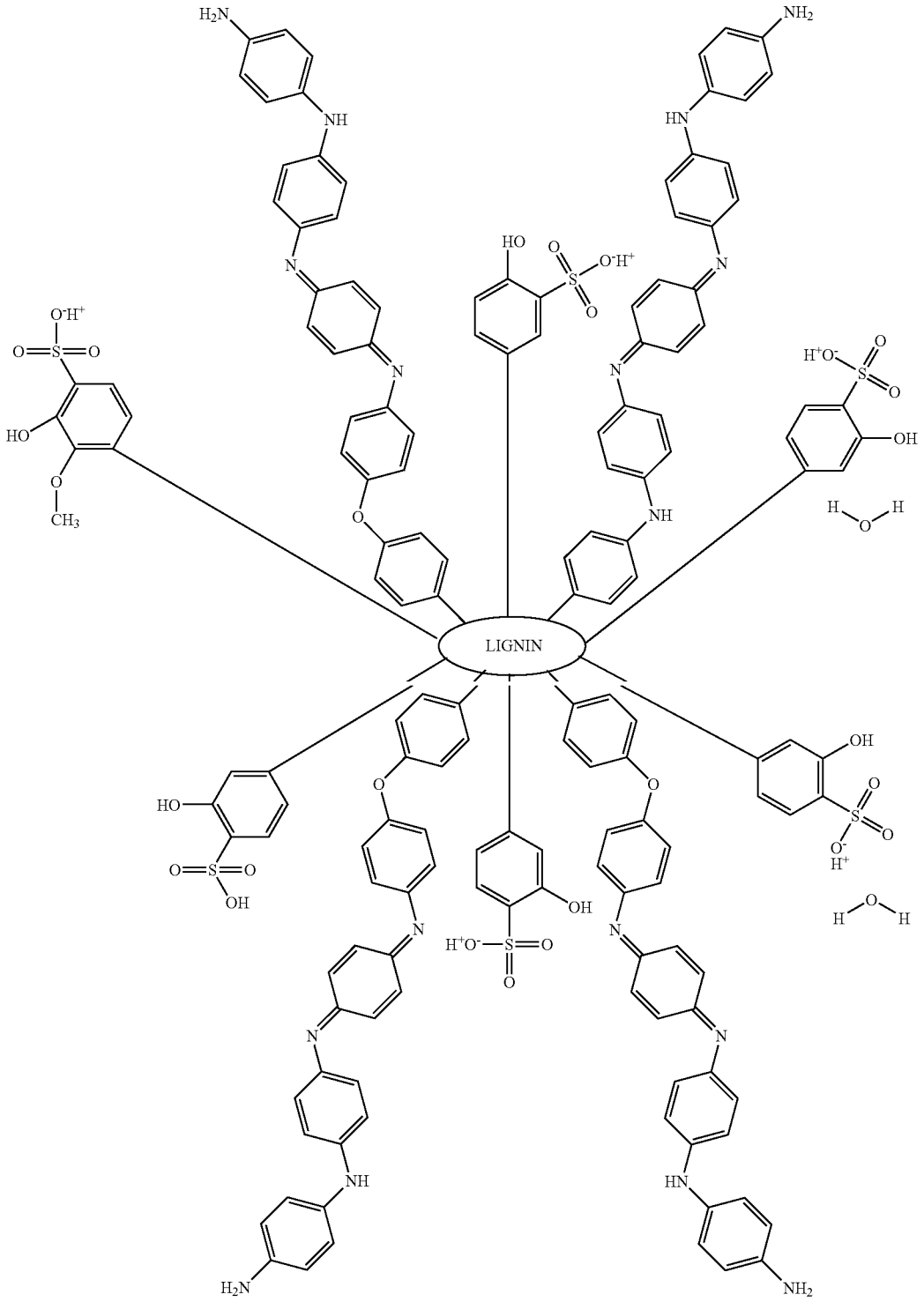

In embodiments, the bulk resistivity of the ground strip layer comprising a film forming polymer and Lino-PANi dispersion is less than about $14\times10^7$ ohms-cm, or from about $14\times10^7$ ohms-cm to about 1 ohms-cm, or from about 135 to about 13 ohms-cm.

Ligno-PANi is present in the binder to form the ground strip layer of the photoreceptor in an amount of from about 20 to about 60 percent by weight, or from about 45 about 60, or from about 40 to about 50 percent by weight, or from about 35 to about 45 percent weight of total solids. Total solids, as used herein, refer to the amount of solids (such as binders, fillers, Ligno-PANi, and other solids) present in the ground strip layer.

A second filler or more than one second filler, in addition to Ligno-PANi, can be present in the ground strip. Examples of suitable fillers include inorganic fillers (such as silica, and the like), metals, metal oxides, polymer fillers, doped metal oxides, carbon fillers, and the like, and mixtures thereof. Examples of suitable fillers include carbon fillers such as graphite, carbon black, fluorinated carbon such as ACCUFLUOR® or CARBOFLUOR® from Advance Research Chemicals, Caroosa, Okla., and like carbon fillers, and mixtures thereof. Other examples include inorganic fillers such as silicas; metal oxide fillers such as copper oxide, iron oxide, magnesium oxide, aluminum oxide, zinc oxide, and the like, and mixtures thereof; doped metal oxide fillers such as antimony doped tin oxide (for example, ZELEC®), and the like, and mixtures thereof. Other examples include polymer fillers such as polytetrafluoroethylene (PTFE), stearates, polyalkylenes (such as waxy polyethylene, wax polypropylene, and the like), and the like and mixtures thereof. Other fillers may be used, such as fillers having a purpose of altering the surface and mechanical properties. These include polytetrafluoroethylene powder, microcrystalline silica, and the like. A specific example of a filler is ZONYL® polytetrafluoroethylene powder available from DuPont or POLYMIST® powder available from Ausimont. Other examples include microcrystalline silica available from Malvern Minerals.

If present, the second filler is present in the ground strip in an amount of from about 1 to about 10, or from about 2 to about 5 percent by weight of total solids.

The dispersion of Ligno-PANi into a binder and used as a ground strip, in embodiments, creates an intense dark green color to give absolute opacity which reduces or eliminates optical problems. Ligno-PANi is a redox active highly dispersible powdery particle. Its small particle size can be easily incorporated or dispersed into a wide range of binders. However, if smaller particles size is needed, this can be obtained by subjecting the filler through a classification process. Also, the dark green color makes the dispersion in a polymer matrix opaque at specific loading levels. The dispersion of Ligno-PANi, in embodiments, represents an improved material formulation which is relatively simple to process, and provides electrical conductivity to meet ground strip layer opacity requirements.

All the patents and applications referred to herein are hereby specifically, and totally incorporated herein by reference in their entirety in the instant specification.

The following Examples further define and describe embodiments herein. Unless otherwise indicated, all parts and percentages are by weight.

EXAMPLES

Example 1

Imaging Member Preparation

A flexible electrophotographic imaging member web, having a structure as that illustrated in FIG. 2, was prepared by providing a roll of titanium coated biaxially oriented thermoplastic polyester (PET, Melinex, available from ICI Americas Inc.) substrate having a thickness of 3 mils (76.2 micrometers). Applied thereto, using a gravure applicator was a solution containing 50 parts by weight of 3-aminopropyltriethoxysilane, 50.2 parts by weight of distilled water, 15 parts by weight of acetic acid, 684.8 parts by weight of 200 proof denatured alcohol, and 200 parts by weight of heptane. This layer was then dried to a maximum temperature of 290° F. (143.3° C.) in a forced air oven. The resulting blocking layer had a dry thickness of 0.05 micrometer.

An adhesive interface layer was then prepared by applying to the blocking layer a wet coating containing 5 percent by weight, based on the total weight of the solution, of polyester adhesive (MOR-ESTER 49,000, available from Morton International, Inc.) in a 70:30 volume ratio mixture of tetrahydrofuran/cyclohexanone. The adhesive interface layer was dried to a maximum temperature of 275° F. (135° C.) in a forced air oven. The resulting adhesive interface layer had a dry thickness of 0.07 micrometers.

The adhesive interface layer was thereafter coated with a photogenerating layer containing 7.5 percent by volume of trigonal selenium, 25 percent by volume of N,N'-diphenyl-N,N'-bis(3-methylphenyl)-1,1'-biphenyl-4,4'-diamine, and 67.5 percent by volume of polyvinylcarbazole. This photogenerating layer was prepared by introducing 160 grams of polyvinylcarbazole and 2,800 mls of a 1:1 volume ratio of a mixture of tetrahydrofuran and toluene into a 400 oz. amber bottle. To this solution was added 160 grams of trigonal selenium and 20,000 grams of ⅛ inch (3.2 millimeters) diameter stainless steel shot. This mixture was then placed on a ball mill for 72 to 96 hours. Subsequently, 500 grams of the resulting slurry were added to a solution of 36 grams of polyvinylcarbazole and 20 grams of N,N'-diphenyl-N,N'-bis(3-methylphenyl)-1,1'-biphenyl-4,4'-diamine dissolved in 750 mls of 1:1 volume ratio of tetrahydrofuran/toluene. This slurry was then placed on a shaker for 10 minutes. The resulting slurry was thereafter applied to the adhesive interface by extrusion coating to form a layer having a wet thickness of 0.5 mil (12.7 micrometers). However, a strip about 3 mm wide along one edge of the coating web, having the blocking layer and adhesive layer, was deliberately left uncoated by any of the photogenerating layer material to facilitate adequate electrical contact with the ground strip layer that is applied later. This photogenerating layer was dried to a maximum temperature of 280° F. (138° C.) in a forced air oven to form a dry thickness photogenerating layer having a thickness of 2.0 micrometers.

This coated imaging member web was simultaneously coated over with a charge transport layer and a ground strip layer by co-extrusion of the coating materials. The charge transport layer was prepared by introducing into an amber glass bottle in a weight ratio of 1:1 (or 50% wt of each) of N,N'-diphenyl-N,N'-bis(3-methylphenyl)-1,1'-biphenyl-4,4'-diamine and MAKROLON 5705, a Bisphenol A polycarbonate thermoplastic, poly(4,4'-isopropylidene-diphenylene carbonate), having a molecular weight of about 120,000, and commercially available from Farbensabricken Bayer A.G. The resulting mixture was dissolved to give 15 percent by weight solid in methylene chloride. This solution was applied on the photogenerator layer by extrusion to form a coating, which upon drying gave a thickness of 24 micrometers.

The strip, about 3 mm wide, of the adhesive layer left uncoated by the photogenerator layer, was coated with a ground strip layer during the co-extrusion process. The ground strip layer coating mixture was prepared by combining 23.81 grams of MAKROLON 5705 and 332 grams of methylene chloride in a Carboy container. The container was covered tightly and placed on a roll mill for about 24 hours until the polycarbonate was dissolved in the methylene chloride. The resulting solution was mixed for 15–30 minutes with about 93.89 grams of graphite dispersion (12.3 percent by weight solids) of 9.41 parts by weight of graphite, 2.87 parts by weight of ethyl cellulose and 87.7 parts by weight of solvent (Acheson Graphite dispersion RW22790, available from Acheson Colloids Company) with the aid of a high shear blade, Dispax Dispersator, dispersed in a water cooled, jacketed container to prevent the dispersion from overheating and losing solvent. The viscosity of the resulting dispersion, if necessary, was adjusted with the aid of methylene chloride. This ground strip layer coating solution mixture was then applied, by co-extrusion with the charge transport layer, to the electrophotographic imaging member web to form an electrically conductive ground strip layer, after drying, of about 14 micrometers dried thickness.

The resulting imaging member web containing all of the above layers was then passed through a temperature of 248° F. (120° C.) in a forced air oven to simultaneously dry both the charge transport layer and the ground strip layer.

The electrophotographic imaging member web, at this point if unrestrained, would spontaneously curl upwardly into a 1½ inch diameter tube. Therefore, the application of an anti-curl back coating was required to provide the desired imaging member web flatness. An anti-curl back coating was prepared by combining 88.2 grams of polycarbonate resin (MAKROLON 5705) and 7.1 grams Vitel PE-200 (a coployester adhesion promoter available from Goodyear Tire and Rubber Company) and 975.1 grams of methylene chloride in a carboy container to form a coating solution containing 8.9 percent polymer solids. The container was covered tightly and placed on a roll mill for about 24 hours until the polycarbonate and the copolyester were dissolved in the methylene chloride to give the anti-curl back coating solution. The anti-curl back coating solution was then applied to the rear surface (side opposite the photogenerator layer and charge transport layer) of the electrophotographic imaging member web by extrusion coating and dried to a maximum temperature of 220° F. (104° C.) in a forced air oven to produce a dried coating layer having a thickness of 13.5 micrometers and render imaging member flatness.

The prepared electrophotographic imaging member web was cut to give sheets of desired lengths and converted into seamed flexible imaging member belts by an ultrasonic seam welding process. When functioning in a xerographic machine, the ground strip layer of each flexible belt provided essential electrical connection and continuity to the conductive ground plane during electrophotographic imaging processes.

Example 2

Control Ground Strip Preparation

A control ground strip layer, identical to the compositions described in the flexible electrophotographic imaging member web, was prepared by following the three steps of standard hand coating procedures described below:

Applied to a 9 inch×12 inch titanium coated biaxially oriented thermoplastic polyester substrate (PET, MELINEX, available from ICI Americas Inc.) having a 3 mils inch thickness (76.2 micrometers) and using a 0.5 mil gap Bird applicator, was a solution containing 5 parts by weight of 3-aminopropyltriethoxysilane, 5.02 parts by weight of distilled water, 1.5 parts by weight of acetic acid, 684.8 parts by weight of 200 proof denatured alcohol, and 200 parts by weight of heptane. The applied wet coating layer was then dried at 290° F. (143.4° C.) in a forced air oven to give a resulting blocking layer of about 0.05 micrometer in dry thickness. An adhesive interface layer was then prepared by applying over the blocking layer, by hand coating with a 0.3 mil-gap Bird applicator, a wet coating containing 0.7 percent by weight, based on the total weight of the solution, of polyester adhesive (MOR-ESTER 49,000, available from Morton International, Inc.) in a 70:30 volume ratio mixture of tetrahydrofuran/cyclohexanone. The adhesive interface layer was dried at 275° F. (135° C.) in a forced air oven to produce a dry thickness of about 0.07 micrometers adhesive interface layer to complete the preparation of the substrate sheet.

A standard ground strip layer coating solution mixture was prepared by dissolving 5.25 grams of MAKROLON 5705 (a Bisphenol A polycarbonate thermoplastic poly(4,4'-isopropylidene-diphenylene carbonate) having a molecular weight of about 120,000 commercially available from Farbensabricken Bayer A.G) in 73.17 grams methylene chloride inside a glass container. The resulting solution was mixed for 15–30 minutes with about 20.72 grams of graphite dispersion (12.3 percent by weight solids) of 9.41 parts by weight of graphite, 2.87 parts by weight of ethyl cellulose and 87.7 parts by weight of solvent (Acheson Graphite dispersion RW22790, available from Acheson Colloids Company) with the aid of a high shear blade dispersed in a water cooled, jacketed container to prevent the dispersion from overheating and losing solvent.

The prepared ground strip layer coating solution mixture was then applied, again by hand coating and a 3-mil gap Bird applicator, over the prepared substrate sheet described above to form an electrically conductive ground strip layer, after drying for 5 minutes at 248° F. (120° C.), of about 14 micrometers in dried thickness which is opaque and black in color.

Example 3

Ground Strip Containing Binder and LIGNO-PANI

Six 9 inch×12 inch titanized polyester substrate supports to contain a blocking layer and an adhesive interface layer were prepared by following the same procedures and using identical materials as those described in the Example 2 above. Six Ligno-PANi ground strip layer coating solutions were formulated by dispersing various predetermined amounts of Ligno-PANi (lignin sulfonic acid doped polyaniline particles available from Seepott, Inc.) in each solution comprising 9 grams of MAKROLON 5705 dissolved in 91 grams of methylene chloride. Again with the aid of a high shear blade mechanical dispersator, each of the prepared ground strip layer formulations was applied, by hand coating using a 3 mil gap Bird applicator, over each individual substrates, to give six levels of 10, 20, 30, 40, 45, and 50 weight percent Ligno-PANi dispersions in the ground strip layers. The layers were dried to a thickness of about 14.3 micrometers. In addition, the formulated ground strip layers have an intense dark green color to render absolute optical opacity.

Example 4

Ground Strip Containing Binder and LIGNO-PANI Testing

The ground strip was tested for resistivity. The results are shown in the Table 1 below. The data given in the table indicate that an electrical insulating film forming polymer, such as polycarbonate, could be rendered conductivity by incorporation of Ligno-PANi dispersion in its material matrix. At about 50 weight percent Ligno-PANi dispersion level in MAKROLON, the ground strip layer formulation, if adopted for imaging member belt application, could provide effective conductivity function equivalent to that of the standard ground strip layer control counterpart. However, from achieving adequate grounding consideration, a 40 weight percent of Ligno-PANi dispersion in MAKROLON, providing a volume electrical resistivity of 135 ohm-cm, did exceed the 200 ohms-cm ground strip layer bulk resistivity specification, therefore it should be sufficient to meet effectual electrical grounding function need.

It is also worth mentioning that these ground strip layers did form a cohesive bonding to the charge transport layer, since the same polymer binder was used in the ground strip formulations as well as the charge transport layer. Furthermore, strong ground strip adhesion strength to both the charge generating layer and the adhesive interface layer were also noted to exceed 95 grams/cm 180° peel strength.

Although the ground strip layers have been found to have about the same wear resistance and frictional property as compared to the standard ground strip control, the addition of 5 weight percent of micro-crystalline silica or PTFE dispersion in each of these ground strip layer formulations could produce a two times wear resistance enhancement result when wear test was conducted against mechanical sliding action over a glass surface. If further wear resistant improvement is desired, these fillers may be incorporated in the ground strip layer by up to 20 weight percent loading level.

TABLE 1

| Ground Strip Layer Ligno-PANi Dispersion (weight %) | Bulk Resistivity Resistivity (ohms-cm) |
|---|---|
| Standard Ground Strip Control - (0%) | 13 |
| 10% | $13.2 \times 10^9$ |
| 20% | $13.8 \times 10^7$ |
| 30% | $11.5 \times 10^4$ |
| 40% | 135 |
| 50% | 12.8 |
| 60% | 1.6 |

While devices have been described in detail with reference to specific and embodiments, it will be appreciated that various modifications and variations will be apparent to the artisan. All such modifications and embodiments as may readily occur to one skilled in the art are intended to be within the scope of the appended claims.

What is claimed is:

1. An electrostatographic imaging member comprising a flexible supporting substrate, an imaging layer capable of retaining an electrostatic latent image, and an electrically conductive ground strip layer comprising a film forming binder and a first filler comprising a lignin sulfonic acid doped polyaniline dispersion, wherein said electrically conductive ground strip layer further comprises a second filler comprising silica.

2. An electrostatographic imaging member in accordance with claim 1, wherein said lignin sulfonic acid doped polyaniline is present in said electrically conductive ground strip layer in an amount of from about 20 to about 60 percent by weight of total solids.

3. An electrostatographic imaging member in accordance with claim 2, wherein said ligno sulfonic acid doped polyaniline is present in said electrically conductive ground strip layer in an amount of from about 40 to about 50 percent by weight of total solids.

4. An electrostatographic imaging member in accordance with claim 3, wherein said lignin sulfonic acid doped polyaniline is present in said electrically conductive ground strip layer in an amount of from about 35 to about 45 percent by weight of total solids.

5. An electrostatographic imaging member in accordance with claim 1, wherein said film forming binder is a film forming polymer selected from the group consisting of polycarbanate, polyester, polyarylate, polyacrylate, polyether, polysulfane, polystyrene, polyurethane, polyamide, polyimide, polyvinyls, polyalkylenes, and mixtures thereof.

6. An electrostatographic imaging member in accordance with claim 5, wherein said film forming binder is a polycarbonate selected from the group consisting of poly(4,4'-isopropylidene-diphenlene carbonate), poly(4,4'-diphenyl-1,1'-cyclohexane carbonate), and poly(4,4'-isopropylidene-3,3'-dimethyl-diphenyl carbonate).

7. An electrostatographic imaging member in accordance with claim 1, wherein said second filler is present in the electrically conductive ground strip layer in an amount of from about 1 to about 10 percent by weight of total solids.

8. An electrostatographic imaging member in accordance with claim 1, wherein said electrically conductive ground strip layer is positioned adjacent said imaging layer.

9. An electrostatographic imaging member in accordance with claim 8, wherein said electrostatographic imaging member further comprises an electrically conductive ground plane layer interposed between said substrate and said imaging layer.

10. An electrostatographic imaging member in accordance with claim 1, wherein said electrically conductive ground strip layer has a bulk resistivity from about $14 \times 10^7$ to about than 1 ohms-cm.

11. An electrostatographic imaging member in accordance with claim 10, wherein said electrically conductive ground strip layer has a bulk resistivity of from about 135 to about 13 ohms-cm.

12. An electrostatographic imaging member in accordance with claim 1, wherein said electrically conductive ground strip layer has a thickness of from about 7 to about 42 micrometers.

13. An electrostatographic imaging member in accordance with claim 1, wherein said electrostatographic imaging member is in the form of a belt.

14. An electrostatographic imaging member in accordance with claim 1, wherein said eleotrostatographic imaging member is in the form of a drelt.

15. An image forming apparatus for forming images on a recording medium comprising:

a photoreceptor comprising a charge-retentive surface to receive an electrostatic latent image thereon, said photoreceptor comprising a flexible supporting substrate, an imaging layer capable of retaining said electrostatic latent image, and an electrically conductive ground strip layer comprising a film forming binder and a lignin sulfonic acid doped polyaniline dispersion, wherein said electrically conductive ground strip layer further comprises a second filler comprising silica;

a development component to apply toner to the charge-retentive surface to develop the electrostatic latent image to form a developed toner image on the charge retentive surface;

a transfer component to transfer the developed toner image from the charge retentive surface to a receiving copy substrate; and a fixing component to fuse the developed toner image to the receiving copy substrate.

* * * * *